US007850821B2

(12) United States Patent
Uehara et al.

(10) Patent No.: US 7,850,821 B2
(45) **Date of Patent: *Dec. 14, 2010**

(54) HOUSEHOLD THIN PAPER

(75) Inventors: Tetsuya Uehara, Fujinomiya (JP); Akira Hirasawa, Fujinomiya (JP); Hiroshi Ono, Fujinomiya (JP); Abdolreza Nezamoleslami, Fujinomiya (JP); Kazuaki Fujimori, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/661,008

(22) PCT Filed: Aug. 24, 2005

(86) PCT No.: PCT/JP2005/015335

§ 371 (c)(1),
(2), (4) Date: Nov. 19, 2007

(87) PCT Pub. No.: WO2006/022288

PCT Pub. Date: Mar. 2, 2006

(65) Prior Publication Data

US 2008/0207867 A1 Aug. 28, 2008

(30) Foreign Application Priority Data

Aug. 25, 2004 (JP) ..... 2004-245005
Sep. 2, 2004 (JP) ..... 2004-255106

(51) Int. Cl.
*D21F 11/00* (2006.01)

(52) U.S. Cl. ..... 162/157.3; 162/10; 162/70; 162/72; 162/75; 162/157.2; 528/271; 528/272; 528/491; 528/502 R

(58) Field of Classification Search ..... 528/271, 528/272, 480, 491, 497, 502 R; 162/172, 162/167, 170, 173, 177, 179, 164.7, 164.1, 162/168.1, 158, 157.3, 157.1, 127, 1, 10, 162/12, 24, 25, 26, 70, 72, 75, 76, 157.2, 162/11; 719/332; 604/358; 156/299
See application file for complete search history.

(56) References Cited

U.S. PATENT DOCUMENTS

| | | | | |
|---|---|---|---|---|
| 3,896,807 | A * | 7/1975 | Buchalter | 604/289 |
| 4,210,685 | A | 7/1980 | Login et al. | |
| 5,935,384 | A * | 8/1999 | Taniguchi | 162/172 |
| 6,207,014 | B1 * | 3/2001 | de Haut et al. | 162/164.7 |
| 2002/0114933 | A1 * | 8/2002 | Gould | 428/212 |
| 2002/0146561 | A1 * | 10/2002 | Baumoller et al. | 428/375 |

FOREIGN PATENT DOCUMENTS

| | | |
|---|---|---|
| EP | 0 406 671 | 1/1991 |
| EP | 1 306 073 | 5/2003 |
| JP | H03-213547 | 9/1991 |
| JP | H05-3339880 | 12/1993 |
| JP | 6-257098 | 9/1994 |
| JP | 2806974 | 7/1998 |
| JP | 11-511046 | 9/1999 |
| JP | 3180916 | 4/2001 |
| JP | 2003-138498 | 5/2003 |
| JP | 3454997 | 7/2003 |
| JP | 3494418 | 11/2003 |
| JP | 2004-089492 | 3/2004 |
| JP | 2004-188078 | 7/2004 |
| WO | WO 02/42556 | 5/2002 |

* cited by examiner

*Primary Examiner*—Ling-Siu Choi
*Assistant Examiner*—Frances Tischler
(74) *Attorney, Agent, or Firm*—William L. Androlia; H. Henry Koda

(57) ABSTRACT

A household thin paper, that offers flexibility and further difficulty in tearing, comprising a polyester-based compound represented by General Formula (1):

(1)

wherein $R_1$ is HO— or HO($R_2$O)a-, $R_2$ is an alkylene group having 2 or 3 carbon atoms, only a single type of $R_2$O or two types of $R_2$O can be attached randomly or as a block, "a" is 1 to 200, all "a"s may be same or different in an identical molecule, b is 2 to 100, and $R_3$ is a hydrogen atom or the like.

13 Claims, 4 Drawing Sheets

HOUSEHOLD THIN PAPER

FIELD OF THE INVENTION

The present invention relates to household thin paper, particularly to soft and smooth household thin paper, and more particularly to household thin paper offering moist feeling. As the household thin paper, there listed can be tissue paper, toilet paper, and the like.

BACKGROUND ART

In response to recent changes in life style, a trend toward soft and smooth household thin paper becomes apparent in users. Especially, in the filed of tissue paper, such a trend is significant.

In order to ensure flexibility, addition of a quaternary ammonium salt is known as disclosed in Japanese Patent Publication No. 3180916 (Patent Reference 1). Also as disclosed in Japanese Patent Publication No. 2806974 (Patent Reference 2), addition of a polysiloxane substance is known.

However, in order to impart flexibility to paper, if a softening agent is added so that the paper is soften, paper strength is decreased, thus, for example in the case of tissue paper, it easily tears in blowing a user's nose, in wiping off user's makeup.

On the other hand, in order to impart moist feeling to paper, addition of a moisture retention agent is known. In Patent Reference 3, water-disintegrable paper is proposed, which includes a moisture retention agent such as glycerin, diglycerin, low molecular weight polyethylene glycol or the like, a dry paper strength agent such as carboxymethyl cellulose sodium, starch or the like, and water soluble wax comprising polymeric polyethylene glycol.

However, the water-disintegrable paper does not have enough water-disintegrability to satisfy a level required as toilet paper. In addition to this, a use of a dry paper strength agent tends to damage flexibility of the paper.

[Patent Reference 1] Japanese Patent Publication No. 3180916

[Patent Reference 2] Japanese Patent Publication No. 2806974

[Patent Reference 3] Japanese Patent Publication No. 3454997

SUMMARY OF THE INVENTION

Problems to be Solved by the Invention

A main objective of the present invention is, therefore, to provide household thin paper which is highly excellent both in terms of flexibility and difficulty in tearing. A further objective is to provide household thin paper, particularly when it is used as toilet paper, which is highly excellent both in terms of soft feeling and smoothness as well as moist feeling while paper strength is not so decreased.

Means to Solve the Problems

To solve the problems described above, the present invention is established as follows.

(Invention of Claim 1)

The household thin paper comprising a polyester-based compound represented by General Formula (1):

(1)

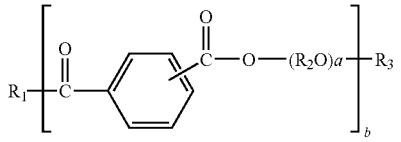

wherein $R_1$ is HO— or HO($R_2$O)a-, $R_2$ is an alkylene group having 2 or 3 carbon atoms, only a single type of $R_2$O or two types of $R_2$O can be attached randomly or as a block, "a" is 1 to 200, all "a"s may be same or different in an identical molecule, b is 2 to 100, and $R_3$ is a hydrogen atom or a group represented by General Formula (2):

(2)

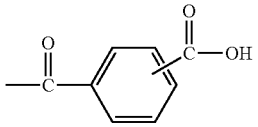

(Invention of Claim 2)

The household thin paper according to claim 1 wherein the above polyester-based compound is added in an amount of 0.05 to 6.0% by mass based on pulp.

(Invention of Claim 3)

The household thin paper according to claim 1 or claim 2 further comprising a moisture retention agent.

(Invention of Claim 4)

The household thin paper according to claim 3 wherein the above moisture retention agent is glycerin.

(Invention of Claim 5)

The household thin paper according to claim 3 or claim 5 wherein the above polyester-based compound represented by General Formula (1) and the above moisture retention agent are contained in an amount of 5 to 60% by mass based on a weight of a sheet in which they are contained.

(Invention of Claim 6)

The household thin paper according to claim 1 or claim 3 wherein a hand value (oil KES) is 3.0 to 6.0.

(Invention of Claim 7)

The household thin paper according to claim 1 or claim 3 wherein a smoothness (MMD) is 5.0 to 15.0.

(Invention of Claim 8)

The household thin paper according to claim 1 or claim 3 wherein a softness is 0.8 to 1.5 g/100 mm.

(Invention of Claim 9)

The household thin paper according to claim 1 or claim 3 wherein dry tensile strength is 200 to 500 cN in a vertical direction and 50 to 200 cN in a lateral direction.

(Invention of Claim 10)

The household thin paper according to claim 1 or claim 3 wherein a basis weight per 1 ply is 10 to 40 g/m$^2$.

Effects of the Invention

The household thin paper according to the present invention offers not only soft feeling but also difficulty in tearing when is used. Further, when the thin paper is used as toilet paper, the advantages such as soft feeling, smoothness as well as moist feeling are offered, while paper strength can be maintained.

BEST MODE FOR CARRYING OUT THE INVENTION

In the thin paper in accordance with the present invention, as a softening agent for the household thin paper, a polyester-based compound represented by General Formula (1) stated before is added to a pulp raw material. Further, when moist feeling is required, a moisture retention agent is also added.

The polyester-based compound represented by General Formula (1) can be produced by a known process from an aromatic dicarboxylic acid or its derivative and a glycol represented by General Formula HO—$(R_2O)$a-H. Such an aromatic dicarboxylic acid may for example be a terephthalic acid, isophthalic acid, phthalic acid, and each derivative may for example be a lower alkyl ester of such a dicarboxylic acid, including a dimethyl ester, diethyl ester, dipropyl ester and dibutyl ester, a chloride of such a dicarboxylic acid, and also a phthalic anhydride. Any one of such aromatic dicarboxylic acids or their derivatives may be used, or the mixture of two or more may be used.

The glycol represented by General Formula HO—$(R_2O)$a-H may for example be an ethylene glycol, propylene glycol, diethylene glycol, dipropylene glycol, polyethylene glycol, polypropylene glycol, and a random or block copolymer of propylene oxide with ethylene oxide having hydroxyl groups at both ends.

Any one of such glycols may be used or a mixture of two or more may be used. In General Formula (1), "a" is 1 to 200, more preferably, 1 to 150. The "a" exceeding 200 results in too high viscosity of the polyester-based compound represented by General Formula (1), which may lead to difficulty in handling. In General Formula (1), all "a"s may be same or different in an identical molecule. The polyester-based compound represented by General Formula (1) in which all "a"s are same can be produced for example by reacting a dimethyl ester of terephthalic acid, isophthalic acid, phthalic acid with a polyethylene glycol having a certain molecular weight and conducting an ester interchange reaction accompanied with a de-methanol reaction or the like. The polyester-based compound represented by General Formula (1) in which a repeating unit having "a" of I and a repeating unit having "a" of several tens to a hundred and several tens can be produced for example by reacting a dihydroxyethyl ester of e.g. a terephthalic acid, isophthalic acid, phthalic acid and the like with a polyethylene glycol having a certain molecular weight and conducting an ester interchange reaction accompanied with a de-ethylene glycol reaction. In General Formula (1), "b" is 2 to 100, more preferably 2 to 30. The "b" exceeding 100 results in too high viscosity of the polyester-based compound represented by General Formula (1), which may lead to difficulty in handling.

In the present invention, the mass-average molecular weight of the polyester-based compound represented by General Formula (1) is preferably 1,000 to 200,000, more preferably 10,000 to 50,000. The mass-average molecular weight of the polyester-based compound less than 1,000 may lead to the insufficient effect of imparted flexibility. The mass-average molecular weight of the polyester-based compound exceeding 200,000 may result in too high viscosity of the polyester-based compound, which may lead to difficulty in handling. The mass-average molecular weight of the polyester-based compound can be determined by a gel permeation chromatography using, as the standard of measurement, a monodispersed polyethylene glycol having a known molecular weight.

In accordance with the present invention, the polyester-based compound represented by General Formula (1) is available in the market as e.g. NICE POLE PR-86, NICE POLE PRS, NICE POLE PR-333, NICE POLE PR-555 (all of them are manufactured by NICCA CHEMICAL CO. LTD) or the like.

While in the household thin paper of the present invention, the polyester-based compound represented by General Formula (1) may be added at a content (in an amount to be added) which is not limited particularly, preferably it is added usually in an amount of 0.05 to 10% by mass, more preferably 0.5 to 5% by mass based on a pulp raw material. An amount of the polyester-based compound represented by General Formula (1) less than 0.05% by mass may lead to an insufficient effect of imparted flexibility. As an amount of the blended polyester-based compound represented by General Formula (1) to the pulp raw material is increased, the effect of imparted flexibility is increased. However, an amount of the polyester-based compound represented by General Formula (1) exceeding 10.0% by mass results in a problem such as stickiness.

The household thin paper in accordance with the present invention may contain a water-soluble polyurethane resin represented by General Formula (3) if necessary. Such a water-soluble polyurethane resin can be added in an amount of 0.05 to 7% by mass based on the pulp raw material. A weight ratio of the polyester-based compound and the water-soluble polyurethane resin is 100/1 to 55/45, preferably 100/1 to 70/30. Thus, one whose major component is the polyester-based compound in accordance with the present invention is preferred.

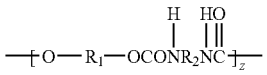

(3)

wherein $R_1$ is a polyalkylene ether glycol chain having the molecular weight of 400 to 5000, $R_2$ is the formulae:

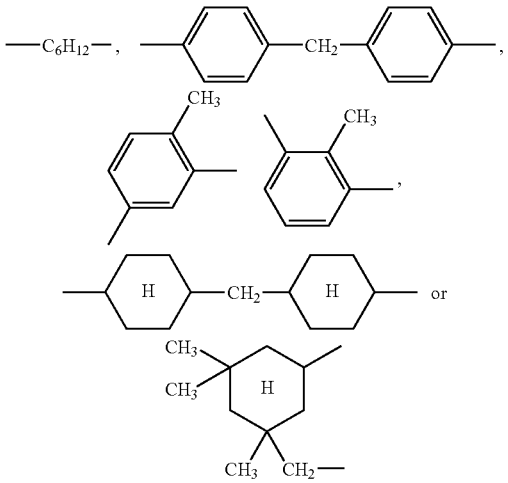

and Z is the integer of 3 to 300.

In the present invention, through an addition of the above polyester-based compound, this compound is attached to pulp fibers while not being affected by a hydrogen bond in the pulp fibers. This attachment offers flexibility as well as protection against a decrease of paper strength. Additionally, it is found that smoothness also can be imparted as is typical of silicone added to household thin paper.

It is preferable that the household thin paper in the present invention has the basis weight per 1 ply of 10.0 to 40.0 g/m$^2$ (it is more preferable that the thin paper used as tissue paper has the basis weight of 11.0 to 17.0 g/m$^2$ and the thin paper used as toilet paper has the basis weight of 12.0 to 25.0 g/m$^2$). The paper having the low basis weight has reduced firmness, which means that the paper has sufficient flexibility. However, excessively low basis weight leads to the decrease of paper strength and the like, thus, the cushioning characteristic cannot be obtained.

For imparting flexibility as well as smoothness as a surface texture, if necessary, the above polyester-based compound can be converted into micro particles for example by means of emulsification so that the micro particles can be used as powder particles. In particular, powder particles whose mean particle size is 0.1 to 30 μm can be used. Alternatively, aggregated particles made of the above powder particles whose mean particle size is 10 to 100 μm can be also used.

On the other hand, silicone powders made of silicone elastomer can be contained together with the above polyester-based compound. The silicone powders, which can be formed by graining for example dimethyl silicone elastomer through emulsification and the like, can be contained. For example, silicone powder particles whose mean particle size is 0.1 to 30 μm or aggregated silicone particles made of the above particles whose mean particle size is 10 to 100 μm such as dimethyl silicone cross linked elastomer (e.g. "BY29-119", "BY29-122" manufactured by DOW CHEMICAL TORAY CO. LTD.) can be used together with the polyester-based compound. Additionally, other than the silicone powder particles, powder particles of polyethylene, polypropylene, acryl and the like can be used together with the polyester-based compound.

In this case, for protection against stickiness, it is preferable that silicone oil having a viscosity of 25 cst or less is used together with the above silicone powders having the mean particle size of 0.1 to 30 μm and these silicone powders are contained in an amount, on dried mass basis, of 0.05 to 5%. In this way, absorbency of oil and water can be properly maintained to a determined level and desired smoothness of the surface, flexibility and further the economical efficiency can be ensured.

It is possible, although not necessarily in usual cases, that another softening agent is added. As the other softening agent, any surfactant can be selected suitably from the group of an anionic surfactant, nonionic surfactant, cationic surfactant and ampholytic surfactant. Due to a use of the anionic surfactant, firmness (bending stiffness) of a paper substrate can be decreased thereby moist feeling imparted by a moisture retention agent and soft feeling imparted by the softening agent can be promoted. As the anionic surfactant, there used can be a carboxylate, sulfonate, sulphate ester, phosphate ester-based surfactant and the like. In particular, an alkyl phosphate ester salt is preferable.

As the nonionic surfactant, there used can be a polyol mono-fatty acid ester such as a sorbitan fatty acid ester, diethylene glycol monostearate, diethylene glycol monooleate, glyceryl monostearate, glyceryl monooleate, propylene glycol monostearate, and the like, N-(3-oleiloxy-2-hydroxypropyl) diethanolamine, polyoxyethylene hydrogenated castor oil, polyoxyethylene sorbit beeswax, polyoxyethylene sorbitan sesquistearate, polyoxyethylene monooleate, polyoxyethylene monolaurate, polyoxyethylene cetylether, polyoxyethylene laurylether and the like.

As the softening agent, which can be preferably used together with the polyester-based compound in accordance with the present invention, there is the cationic surfactant. As the cationic surfactant, there used can be a quaternary ammonium salt, amine salt, amine and the like. Further, as the ampholytic surfactant, there used can be an aliphatic derivative of secondary amines or tertiary amines containing carboxy, sulfonate, and sulfate, an aliphatic derivative of a heterocyclic secondary amine, heterocyclic tertiary amine and the like.

Due to a use of the softening agent, paper strength may be decreased. Accordingly, as a paper strength agent (a wet paper strength agent), there added can be an amine resin e.g. a urea-formaldehyde resin, melamine-formaldehyde resin and the like, polyamide epichlorohydrin-based resin, polyvinyl alcohol, dialdehyde starch, and the like with starch being especially used.

Additionally, in order to obtain inter alia moist feeling, together with the above polyester-based compound, a moisture retention agent can be added effectively. Particularly, glycerin can be used actively. Although an addition of the glycerin improves a texture such as moist feeling, it has been found that paper strength is damaged by an increase of water due to the moisture retention agent. In this respect, since the above polyester-based compound offers smoothness to the pulp fibers while not being affected by a hydrogen bond in the pulp fibers, a large amount of the glycerin is not required. As a result, the paper strength is not decreased, or very little if any.

When the polyester-based compound is contained together with the moisture retention agent in a seat, an amount is preferably 5 to 60% by mass, particularly 10 to 30% by mass, with respect to a weight of the sheet (generally containing about 5 to 6% of water).

In the present invention, as a moisture retention agent, glycerin is preferably added. As other applicable moisture retention agents, there listed can be an agent containing at least one selected from the group of polyols such as diglycerin, propylene glycol, 1,3-butylene glycol, polyethylene glycol and the like, sugars such as sorbitol, glucose, xylitol, malt sugar, maltitol, mannitol, trehalose and the like, glycol-based solvents and the derivatives thereof. Additionally, there used can be higher alcohols such as cetanol, stearyl alcohol, oreyl alcohol and the like, liquid paraffin and the like.

In the present invention, as an additive agent, especially when the thin paper is used as tissue paper, there blended can be amino acids such as glycine, aspartic acid, arginine, alanine, cystine, cysteine, and the like, botanical extracts such as *aloe* extract, *hydrangea macrophylla* leaf extract, *chaenomeles sinensis* fruit extract, cucumber fruit extract, *equisetum arvense* extract, tomato fruit extract, *rosa canina* fruit extract, *luffa cylindrica* extract, *lilium candidum* bulb extract, *astragalus sinicus* extract, and the like, vegetable oils such as olive fruit oil, jojoba seed oil, *rosa canina* fruit oil, sweet almond oil, *eucalyptus globulus* oil, avocado oil, tsubaki oil, soybean oil, safflower seed oil, sesame seed oil, evening primrose oil and the like, vitamins, hydrolyzed collagen, hydrolyzed keratin, hydrolyzed silk, chitosan, urea, honey, royal jelly, sodium hyaluronate, ceramide, squalane, petrolatum, vitamin C, vitamin E, collagen and the like.

Among these additive agents, the vitamin C, vitamin E and collagen have a function for improving moist feeling. Further, the vitamin C and E can serve as antioxidant agents. The vitamin E has high reducing capacity with antioxidant property, thereby active oxygen, free radical can be removed and the generation of peroxidized lipids can be prevented. Accordingly, the vitamin E serves as a stabilizing agent for other chemicals and offers, when is given to user's skin in a use of the thin paper, protection against oxidation as well as improved blood circulation in user's sebum. Additionally, the vitamin E has also a moist retention function. The vitamin C offers also protection against oxidation in the user's sebum like the vitamin E. Further the vitamin C has ability to reduce the vitamin E. Thus, in a use of the both of vitamin C and E, even if the vitamin E is oxidized by an active oxygen, since the vitamin C acts as an aid for the vitamin E, the vitamin E can be reduced. As a result, the vitamin C has an effect of keeping a level of an antioxidant property of the vitamin E in the user's sebum. On the other hand, the collagen amounts to 90% of corium, thus, a decrease of the collagen lessens skin moisture as well as resiliency. Accordingly, the collagen contained in the thin paper fulfils moisture retention effect, by which moisture is given to the user's skin contacted with the thin paper. In addition to this, the collagen has a moist retention effect for the thin paper in the same manner.

As a paper substrate for the thin paper in accordance with the present invention, each pulp fiber whose NBKP is 30 to 80% and whose LBKP is 20 to 70% is employed preferably in a major part. While the paper substrate can contain, based on a pulp raw material, 30% or less, preferably 10% or less of waste paper pulp if necessary, one containing 100% of virgin pulp is more preferable in view of flexibility and the like.

On the other hand, since the thin paper tears too easily if tensile strength is excessively low, it is preferable that dry tensile strength in a vertical direction is 200 to 500 cN/25 mm width and dry tensile strength in a lateral direction is 50 to 200 cN/25 mm width. Especially, such thin paper does not tear easily in an actual use, for example in blowing a user's nose. Additionally, such thin paper can be picked up from a carton smoothly while it does not tear easily on picking. The dry tensile strength in the vertical direction and the dry tensile strength in the lateral direction are measured based on JIS P 8113.

A softness (tested using HANDLED-O-METER according to JAPAN TAPPI PAPER AND PULP TESTING METHOD No. 34:2000) is preferably 0.8 to 1.5 g/100 mm.

For the household thin paper in accordance with the present invention, it is particularly important to be smooth on its surface. The smoothness represented by the mean deviation of friction coefficient (MMD; Mean Deviation of MIU, MIU; Mean coefficient of friction) in surface properties obtained from a KES TESTER is preferably 5.0 to 15.0 (more preferably 8.0 to 12.0).

In the test for determining this surface property, "FRICTION TESTER KES SE" manufactured by KATO TECH CO., LTD can be used. In measuring, as shown in FIG. 1, a friction coefficient is measured by moving a friction probe, which is made of a piano wire having a cross sectional diameter of 0.5 mm, which has a length of 5 mm in its contact surface and which is brought into contact with a paper sample with a pressure load of 10 g, at a moving rate of 0.1 cm/sec for a moving distance of 2 cm with a tensile strength of 20 g/cm supplied on a moving direction to the paper sample. That is to say, a mean deviation of friction coefficient (MMD) is an amount of area designating totally geometrical surface roughness in moving of the frictional probe divided by the moving distance (2 cm). In this context, the MMD reflects smoothness.

In the present invention, a hand value (oil KES) as an average of surface properties in a longitudinal direction and those in a lateral direction is represented by an average deviation of a friction coefficient and is preferably 3.0 to 6.0. This friction coefficient is measured with a contact surface, which is made of an artificial leather piece being 10 mm×10 mm in size and is coated evenly with 4 mg of olive oil. Then, this contact surface is totally brought into contact with a paper sample, which is fixed on a horizontally disposed measuring surface made of an artificial leather sheet, with the contact pressure of 50 gf/cm$^2$, and in this situation, the contact surface is moved together with the paper sample at a moving rate of 0.1 cm/sec for a distance of 2 cm with a tensile strength of 20 gf/cm supplied to the paper sample on its moving direction.

Precisely, in measuring, as shown in FIGS. 2 to 4, first, the artificial leather sheet (SUPPLALE manufactured by IDEMITSU TECHNOFINE CO., LTD.) is mounted and fixed on the base of a usual MMD tester, for example, "FRICTION SENSITIVE TESTER KES SE" manufactured by KATO TECH CO., LTD. Next, a measuring terminal T is covered with the artificial leather piece (SUPPLALE manufactured by IDEMITSU TECHNOFINE CO., LTD.) and thus covered part (contact surface) in a measuring face of the measuring terminal is coated evenly with 4 mg of olive oil (BOSCO EXTRA VIRGIN OIL manufactured by NISSHIN OILLIO GROUP LTD). Then, measurement is performed in the same way as the measuring procedure of MMD. In detailed explanation, the contact surface made of the above artificial leather piece is formed by covering, with this artificial leather piece, the MMD measuring terminal, which comprises continuously arranged piano wires each having a cross sectional diameter of 0.5 mm and a swollen tip curvature radius of 0.25 mm with a full width of 10 mm so as to be a continuous measuring face being approximately 10 mm×10 mm in size. Such covering of the above terminal with the artificial leather piece is attained by putting tightly this piece on the measuring face of the terminal, with some amount of tensile force if necessary, so as to form the above contact surface being 10 mm×10 mm in size. It is important for the artificial leather piece to be fixed surely on the terminal. By doing so, in the measuring, namely in moving the paper sample, the piece is not displaced with relation to the terminal. Thus, distortion or the like will not be generated on the contact surface made of the artificial leather piece. In order to attain this, for example, after covering the terminal with the artificial leather piece for forming the above contact surface, the artificial leather piece is bound with rubber bands at its positions, which are not included in the contact surface, so as to be fixed on the parts of the tester, which do not affect the measurement, such as a supporting member of the terminal. On the other hand, the artificial leather sheet is fixed on the base of the MMD tester with adhesive tapes. In this situation, it is important for the artificial leather sheet to be fixed surely on the base so that distortion is not generated on this sheet in measuring. The artificial leather used for the sheet mounted on the base is the same is that of the piece covering the terminal. As the paper sample, paper is cut to have a size of 10 cm×10 cm. Then, the paper sample is fixed on the artificial leather sheet mounted on the base. In measuring, the paper sample is pressed by a weight (about 10 g) placed on the sample. Due to a load of 50 g supplied to the measuring terminal of the tester, a total contact surface made of the artificial leather piece is brought into contact with the paper sample with a contact pressure of 50 gf/cm$^2$. For attaining this, a disc-shaped weight is secured to the tester so as to locate over the terminal in the same manner as the measuring procedure of MMD. It is needless to say that another end (in a side being opposite of a side the paper sample is moved toward) of the supporting member is secured to the tester in the same manner as the measuring procedure of MMD. Measuring is repeated 6 times; 3 times in a vertical direction of the paper sample and 3 times in a lateral direction of the paper sample for obtaining the average of these 6 results as a measurement value. The artificial leather and olive oil can be replaced by the equivalents.

The surface properties of the household thin paper in accordance with the present invention can be adjusted by varying pulp incorporation, calendar condition, paper moisture, doctor blade tip angle, blade angle, balance between adhesion·peeling strength, crepe rate, an addition of the above additives (including the moisture retention agents) and their quantities.

The polyester-based compound in accordance with the present invention can be dissolved or dispersed in water because of its water-solubility. However, since this compound has high molecular weight, it is used preferably as being dissolved in isopropyl alcohol, dipropylene glycol and the like.

The household thin paper in accordance with the present invention can be produced by a known facility and a known process. Thus, a pulp raw material may be subjected to a paper making machine followed preferably by a crepe treatment and calendar treatment.

The polyester-based compound represented by General Formula (1) in accordance with the present invention can be coated (together with a moisture retention agent (particularly glycerin) if necessary) in the following way. Precisely, after paper making, the polyester-based compound can be spray coated. In the case of tissue paper, in a particularly preferable manner, base paper machined from pulp fibers is reeled in order to form roll paper having a predetermined width, then, a continuous sheet is unreeled from the roll paper so as to be folded and piled to be adapted for each household thin paper product in a folding machine; INTER FOLDER. Between a step of reeling and a step of folding and piling, the above chemical is coated continuously on the continuous sheet by transfer in a use of rolls.

When the chemical is coated by the transfer in the use of rolls, a larger amount of chemical can be coated on a paper substrate comparing with the case of spray coating. Additionally, since on-line coating is performed in a folding machine; INTER FOLDER, elongation of the paper can be prevented while a basis weight can be lowered, resulting in small firmness or improved textures. Accordingly, flexibility can be obtained even if an amount of chemical for coating is small. A small basis weight and a small amount of coated chemical can lead to a high economical sufficiency. For coating the chemical by the transfer in the use of rolls, although gravure roll is preferably employed, flexographic roll can be also employed.

In the above explanation about the properties, the paper is in the form of 1-ply. However, the household thin paper in accordance with the present invention may be in the form of 2-ply or 3-ply or more. Further, the present invention exerts an especially significant effect when it is used as tissue paper required to have desired paper strength. However, the paper of the present invention can be used also as toilet paper.

Example

Example in the Case of Tissue Paper

As for tissue paper products available in the market and tissue paper products in accordance with the present invention, properties and the like were examined. The results are shown in Table 1.

In Table 1, as the softening agents, the polyester-based compound (1) was "A-POLE ES-500" manufactured by NIKKA CHEMICAL CO. LTD. and the polyester-based compound (2) was "L-4328" manufactured by NIKKA CHEMICAL CO. LTD. The polyester-based compounds (1) and (2) were represented by General Formula (1).

In each Comparative Example, so-called a soft type tissue paper product was used. A softening agent of Comparative Example 1 was a cationic fatty acid ester ("SFS1002" manufactured by JAPAN PMC CO. LTD).

TABLE 1

| | | Example 1 | Example 2 | Example 3 | Comparative Example 1 Applicant's Marketed product | Comparative Example 2 A company's product | Comparative Example 3 B company's product |
|---|---|---|---|---|---|---|---|
| Basis weight per 1 ply | $g/m^2$ | 12.0 | 12.0 | 12.0 | 12.0 | 12.7 | 11.1 |
| Softening agent | | Polyester-based compound (1): 1.5% | Polyester-based compound (1): 0.03% | Polyester-based compound (2): 1.5% | Fatty acid ester: 0.05% | | |
| Hand value (oil KES) (1 ply) (Artificial leather + Olive oil) | ×100 | 4.7 | 5.8 | 5.5 | 6.9 | 7.7 | 7.3 |
| Dry tensile strength in vertical direction (1 ply) | cN | 280 | 280 | 280 | 230 | 375 | 310 |
| Dry tensile strength in lateral direction (1 ply) | cN | 120 | 120 | 120 | 110 | 90 | 80 |
| Smoothness (MMD) | | 8.2 | 8.3 | 8.2 | 9.3 | 11.8 | 11.0 |
| Softness (g/100 mm) | | 1.08 | 1.05 | 1.12 | 1.00 | 1.22 | 1.32 |
| Airy texture | | ○ | ○ | ○ | ○ | Δ | Δ |
| Massive feeling | | ○ | ○ | ○ | ○ | ○ | Δ |
| Texture in blowing one's nose | | ◎ | ◎ | ◎ | ○ | ○ | Δ |

Thirty adults were surveyed in actual use evaluations and sensory evaluations of the tissue paper products as for items; "texture in blowing one's nose" (smoothness), "airy texture", and "frequency of tearing in blowing one's nose". Then, the evaluation results are ranked with 5 grades; 5 points, 4 points, 3 points, 2 points and 1 point are given for the best, better, normal, worse and worst, respectively. Then, the average point 4.0 or higher, 3.0 or higher but lower than 4.0, 2.0 or higher but lower than 3.0, 1.0 or higher but lower than 2.0 and 1.0 or higher but lower than 2.0 are expressed with ◎, ○, Δ and X respectively.

Discussion

The products according to Examples in the present invention were well-received in the all actual use evaluations and sensory evaluations comparing with the products available in the market. This means that each product of Examples shows superior properties comparing with the products available in the market. Further, each product of Examples excels products using other softening agents at tensile strength and frequency of tearing. Additionally, as for the inventive products using the above series of "NICE POLL PR", the similar results were obtained.

Example in the Case of Toilet Paper

As for toilet paper products of Contrastive Examples and Comparative Example 4, each of which is available in the market and contains glycerin as a moisture retention agent and toilet paper products in accordance with the present invention, properties and the like were examined. The results are shown in Table 2.

In Table 2, the polyester-based compound is "A-POLE ES-500" manufactured by NIKKA CHEMICAL CO. LTD. (When "L-4328" manufactured by NIKKA CHEMICAL CO. LTD. was used, the similar results were obtained).

TABLE 2

| | | Contrastive Example 1 | Contrastive Example 2 | Contrastive Example 3 | Example 4 | Example 5 | Comparative Example 4 (Marketed product) |
|---|---|---|---|---|---|---|---|
| Chemical component (%) | Moisture retention agent such as glycerin | 0 | 100 | 100 | 92 | 84 | 100 |
| | Polyester-based softening agent | 0 | 0 | 0 | 8 | 16 | 0 |
| Coating percentage (%) | | 0 | 15 | 25 | 15 | 15 | 6 |
| Texture | Soft feeling | X | Δ | ○ | ○ | ○ | ○ |
| | Smoothness | X | Δ | ○ | ○ | ◎ | Δ |
| | Moist feeling | X | ○ | ◎ | ◎ | ○ | ○ |
| | Strength | ○ | Δ | X | ○ | ○ | Δ |
| MMD | | 12.0 | 11.3 | 10.8 | 10.6 | 10.1 | 10.8 |
| Softness (g) | | 2.30 | 1.90 | 1.31 | 1.35 | 1.37 | 1.43 |
| Tensile strength in vertical direction (CN) | | 397 | 199 | 159 | 270 | 278 | 280 |
| Tensile strength in lateral direction (CN) | | 153 | 83 | 68 | 108 | 115 | 85 |

Thirty adults were surveyed in actual use evaluations and sensory evaluations as for four items; "soft feeling", "smoothness", "moist feeling" and "strength". Then, the evaluation results are ranked with 5 grades; 5 points, 4 points, 3 points, 2 points and 1 point are given for the best, better, normal, worse and worst, respectively. Then, the average point 4.0 or higher, 3.0 or higher but lower than 4.0, 2.0 or higher but lower than 3.0, 1.0 or higher but lower than 2.0 and 1.0 or higher but lower than 2.0 are expressed with ◎, ○, Δ and X respectively.

Discussion

The products according to Examples 4 and 5 according to the present invention were well-received in the all actual use evaluations and sensory evaluations comparing with the products available in the market. This means that each product of Examples shows superior properties comparing with the products available in the market. Further, each product of Examples 4 and 5 has high sensory properties as well as small value of MMD and excels products using other softening agents at tensile strength and frequency of tearing.

Figure 1:
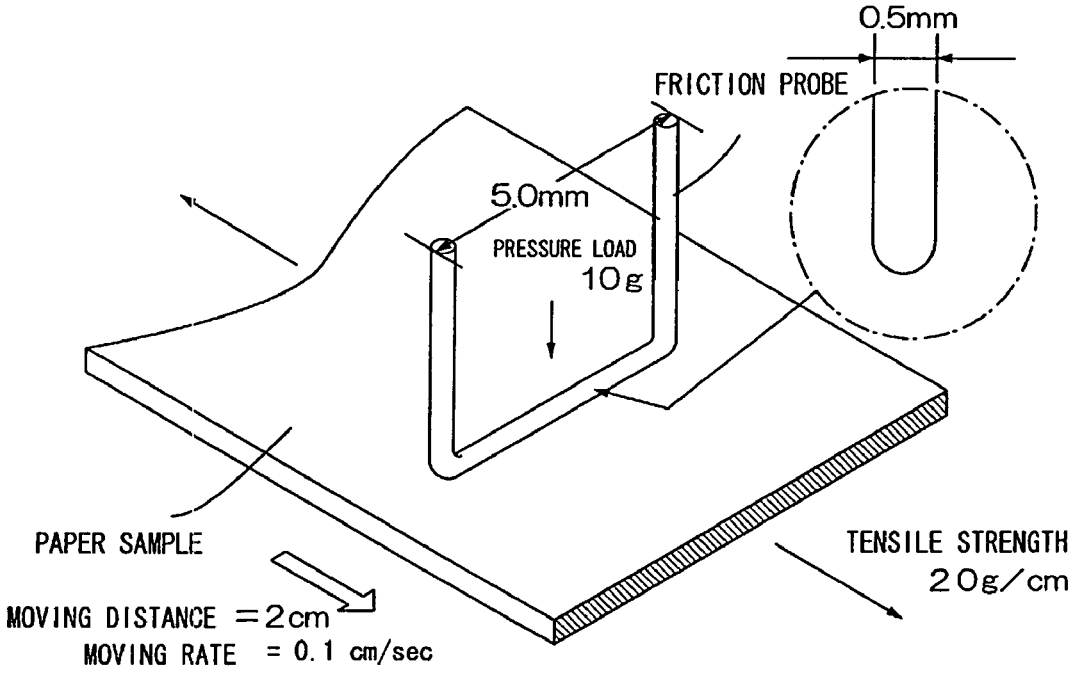
FIG. 1 is a schematic view showing the MMD terminal and measuring thereof.
Figure 2:
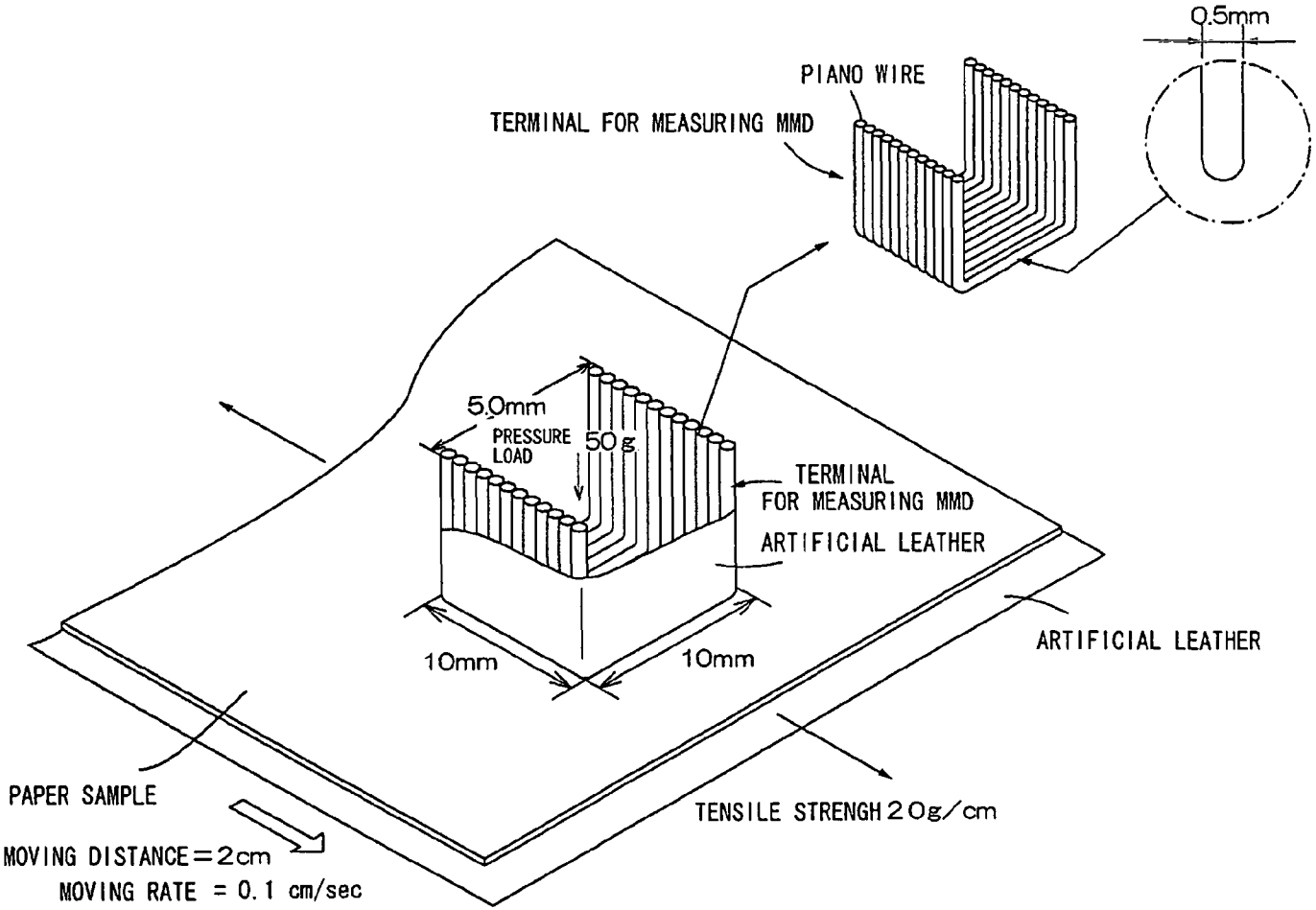
FIG. 2 is a schematic view showing the MMD terminal for the hand value (oil KES) and measuring thereof.
Figure 3:
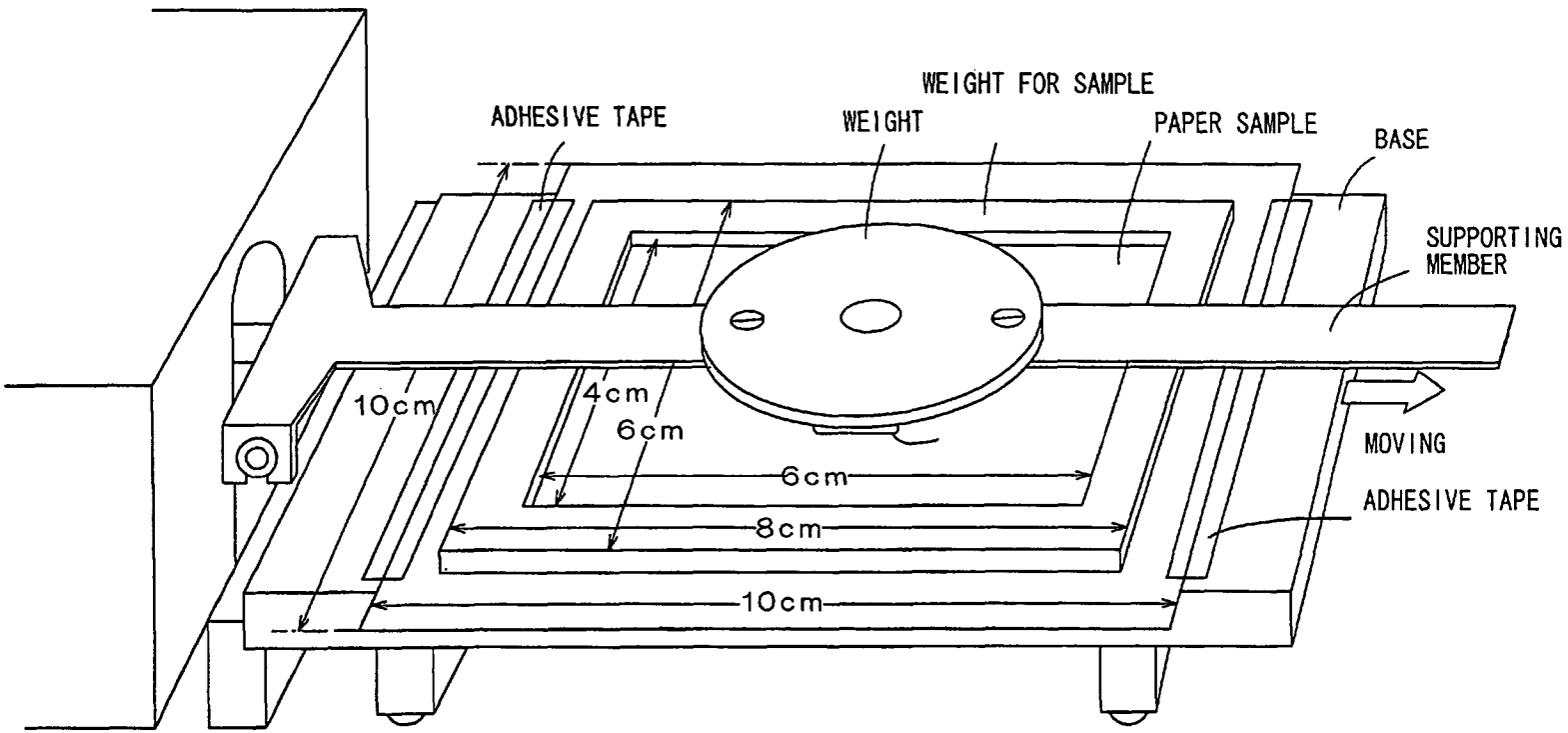
FIG. 3 is a schematic view showing the example of measuring apparatus for surface properties.
Figure 4:
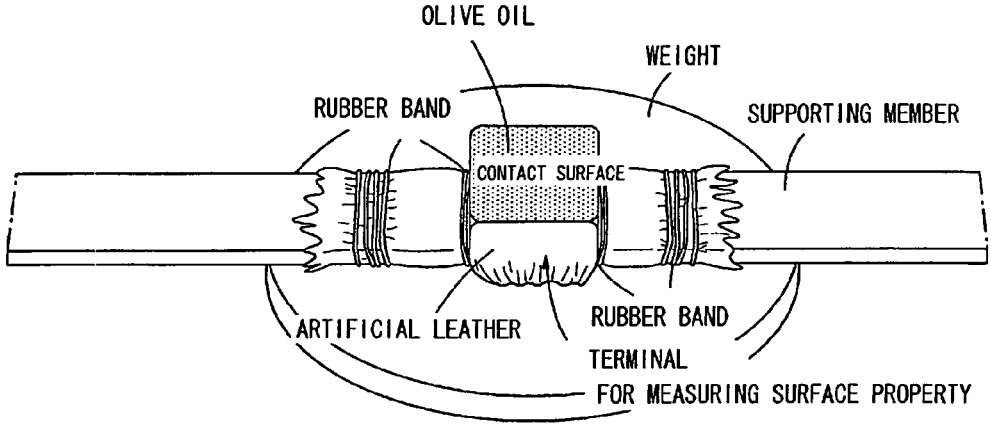
FIG. 4 is a view explaining the contact surface.

What is claimed is:

1. A household thin paper comprising a polyester-based compound represented by General Formula (1):

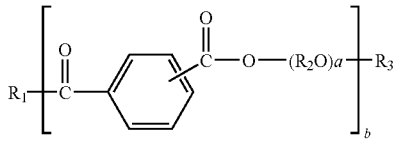

(1)

wherein:

$R_1$ is HO— or HO($R_2$O)a-, $R_2$ is an alkylene group having 2 or 3 carbon atoms, only one type of $R_2O$ or two types of $R_2O$ are attached at random or as a block to the compound, "a" is 1 to 200, all "a"s are same or different in a molecule, b is 2 to 100, and $R_3$ is a hydrogen atom or a group represented by General Formula (2);

(2)

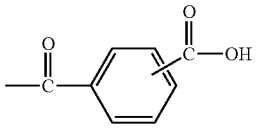

said polyester-based compound is added to pulp raw material in an amount of 0.05 to 6.0% by mass based on said pulp raw material;

the household thin paper further comprises a moisture retention agent;

said polyester-based compound represented by General Formula (1) and said moisture retention agent are contained in an amount of 5 to 60% by mass based on a weight of a sheet in which they are contained;

a basis weight per 1 ply is 10 to 40 g/m$^2$; and said polyester based compound has a mass average molecular weight of 1,000 to 200,000, is a softening agent and is water soluble.

2. The household thin paper according to claim 1 wherein said moisture retention agent is glycerin.

3. The household thin paper according to claim 1 wherein a hand value (oil KES) is 3.0 to 6.0.

4. The household thin paper according to claim 1 wherein a smoothness (MMD) is 5.0 to 15.0.

5. The household thin paper according to claim 1 wherein a softness is 0.8 to 1.5 g/100 mm.

6. The household thin paper according to claim 1 wherein a dry tensile strength is 200 to 500 cN in a machine direction and 50 to 200 cN in a cross direction.

7. The household thin paper according to claim 2 wherein a hand value (oil KES) is 3.0 to 6.0.

8. The household thin paper according to claim 2 wherein a smoothness (MMD) is 5.0 to 15.0.

9. The household thin paper according to claim 2 wherein a softness is 0.8 to 1.5 g/100 mm.

10. The household thin paper according to claim 2 wherein a dry tensile strength is 200 to 500 cN in a machine direction and 50 to 200 cN in a cross direction.

11. The household thin paper according to claim 1, wherein "b" is 2 to 30.

12. The household thin paper according to claim 1, where a powdered particle selected from the group consisting of silicon, polyethylene and polypropylene is added to the pulp raw material with the polyester-based compound.

13. The household thin paper according to claim 12, further comprising a surfactant added to the pulp raw material.

* * * * *